US010683475B2

(12) United States Patent
Piorkowski

(10) Patent No.: US 10,683,475 B2
(45) Date of Patent: Jun. 16, 2020

(54) FRAGRANCED PASTILLE FOR LAUNDRY APPLICATION

(71) Applicant: Henkel IP & Holding GmbH, Duesseldorf (DE)

(72) Inventor: Daniel Thomas Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 13 days.

(21) Appl. No.: 15/969,173

(22) Filed: May 2, 2018

(65) Prior Publication Data

US 2018/0346850 A1 Dec. 6, 2018

Related U.S. Application Data

(60) Provisional application No. 62/513,262, filed on May 31, 2017.

(51) Int. Cl.

| | |
|---|---|
| ***C11D 17/00*** | (2006.01) |
| ***C11D 3/50*** | (2006.01) |
| ***C11D 3/37*** | (2006.01) |
| ***C11D 11/00*** | (2006.01) |
| ***C11D 17/06*** | (2006.01) |

(52) U.S. Cl.

CPC ..... *C11D 3/505* (2013.01); *C11D 3/3707* (2013.01); *C11D 11/0017* (2013.01); *C11D 11/0082* (2013.01); *C11D 17/0047* (2013.01); *C11D 17/06* (2013.01)

(58) Field of Classification Search

CPC ..... C11D 3/505; C11D 3/001; C11D 3/502; C11D 3/507; C11D 17/0052; C11D 11/0017; C11D 17/0047

See application file for complete search history.

(56) References Cited

U.S. PATENT DOCUMENTS

| | | | | |
|---|---|---|---|---|
| 6,130,193 | A | 10/2000 | Gillette | |
| 6,864,196 | B2 | 3/2005 | Graham et al. | |
| 7,871,976 | B1 * | 1/2011 | Aouad | C08K 7/22 512/2 |
| 2009/0014493 | A1 * | 1/2009 | James | B21D 53/74 226/137 |
| 2009/0144913 | A1 | 6/2009 | Yu et al. | |
| 2010/0331225 | A1 * | 12/2010 | Panandiker | C11D 3/001 510/107 |
| 2011/0097369 | A1 | 4/2011 | Sunder et al. | |
| 2013/0095717 | A1 * | 4/2013 | VanBlarcom | B65D 85/808 442/96 |
| 2014/0179587 | A1 * | 6/2014 | Brown | C11D 3/3707 510/349 |
| 2018/0044616 | A1 | 2/2018 | Piorkowski | |
| 2018/0100124 | A1 | 4/2018 | Piorkowski | |

FOREIGN PATENT DOCUMENTS

| | | | |
|---|---|---|---|
| WO | 9964555 | A1 | 12/1999 |

* cited by examiner

*Primary Examiner* — John R Hardee

(74) *Attorney, Agent, or Firm* — Bojuan Deng

(57) ABSTRACT

Provided herein are solid compositions for fabric treatment; unit dose laundry detergent compositions containing solid compositions for fabric treatment; and process of their making and using, e.g., for treating textiles.

20 Claims, No Drawings

FRAGRANCED PASTILLE FOR LAUNDRY APPLICATION

BACKGROUND OF THE INVENTION

Field of the Invention

This application relates to fragranced solid compositions for laundry application, as well as their use and manufacture. The application also relates to laundry detergent compositions employing fragranced solid compositions, and their use and manufacture.

Description of the Related Art

Textiles can have an undesirable smell after washing, and thus are often treated with detergent and/or fabric softener, or by additional treatments and processes that are separate from their washing. The treatments are separate because the compositions used are often not compatible with the washing detergent. These additional processes can be done, for example, in the washer during an added rinse cycle, or in the dryer. However, separate treatments and using increased amounts of detergent and/or fabric softener have drawbacks. For example, an additional rinse cycle will use extra water and electricity to power the washer, which can be detrimental to the environment. Also, some separate treatments employ solid compositions that may not completely solubilize during a wash cycle or a rinse cycle. Such solid compositions can also be brittle and difficult to handle and manufacture.

U.S. Pat. No. 7,867,968 relates to scent additives for textiles which comprise polyethylene glycol ("PEG") and one or more perfumes. The compositions are shaped into a pastille and contain a free and/or an encapsulated perfume, and optionally colorants (such as dyes).

U.S. Pat. No. 7,871,976 discloses laundry scent additives for textiles which comprise PEG and one or more perfumes. The compositions can be shaped into a pastille and contain only encapsulated perfume, and optionally colorants (such as dyes).

United States Patent Application Publication No. 2013/0095717 relates to a solid wash cycle conditioning agents comprising one or more non-ionic surfactants, one or more fabric conditioning agents, optionally one or more plasticizers, optionally one or more colorants, optionally one or more colorant stabilizers, and optionally one or more perfumes. The solid wash cycle conditioning agent can fully or partially coat a core. The solid wash cycle conditioning agents can be included in washing or cleaning products and can be used to treat textiles (i.e., to impart scent or soften or clean or decrease static build up when the treated textile is subsequently dried).

United States Patent Application Publication No. 2016/0160157 relates to a solid wash cycle conditioning agent comprising a non-ionic surfactant (e.g., block copolymers and sorbitan esters) and a fabric conditioning agent. The solid wash cycle conditioning agent can further contain a plasticizer (e.g., polyethylene glycol stearates and glyceryl stearate), a colorant, a colorant stabilizer, and a perfume.

There remains a need for solid compositions to effectively deliver fragrance to textiles that are storage stable, not brittle, and can completely solubilize in the presence of a detergent during a wash cycle.

BRIEF SUMMARY OF THE INVENTION

The processes, compositions, and containers containing the compositions provided in present disclosure are exemplary and are not intended to limit the scope of the claimed embodiments.

One aspect of the present disclosure is a process of making a solid composition for fabric treatment (SCFT) comprising mixing and melting a polyethylene glycol and/or a block copolymer (e.g., copolymers of Formula (I) through (IV) described herein), and a dry powder of encapsulated fragrance to form a mixture, shaping or allowing the mixture to shape, and hardening the shaped mixture.

Currently, compositions for delivering fragrance to textiles are made by incorporating free fragrance and/or encapsulated fragrance slurry into the solid compositions for fabric treatment. It has been discovered that adding higher amounts of free fragrance and/or encapsulated fragrance slurry to the composition can adversely lower the composition's melting point, resulting in temperature instabilities, e.g., melting and/or sticking together during product distribution and storage. The relationship between the amount of fragrance and the melting point of the composition is extremely important when using lower molecular weight components, such as lower molecular weight polyethylene glycol.

The present inventors surprisingly found that the melting point of a solid composition for fabric treatment can be increased, thus improving storage stability, by using a dry powder of encapsulated fragrance, rather than only an encapsulated fragrance slurry or free fragrance, in a process for making the solid composition for fabric treatment.

The solid compositions for fabric treatment made by using a dry powder of encapsulated fragrance, as disclosed herein, allow for an increased fragrance load, while maintaining melting points sufficient to prevent melting, or sticking together, during transport and/or storage.

In one embodiment, the process of making a solid composition for fabric treatment further comprises adding an encapsulated fragrance slurry, a free fragrance, a colorant, a glycol fatty acid ester, a filler, or a combination thereof to the mixture.

In some embodiments, the PEG can have an average molecular weight from about 1000 to about 8500, from about 2000 to about 6000, or from about 2000 to about 4500. In one embodiment, the PEG has an average molecular weight of about 4000.

In some embodiments, the process comprises melting the polyethylene glycol and/or a block copolymer (e.g., copolymers of Formula (I) through (IV) described herein), and then adding the dry powder of encapsulated fragrance to form a mixture.

In some embodiments, the block copolymer has Formulae (I) through (IV): $R^1O$-(EO)x-(PO)y-$R^2$ (Formula (I)), $R^1O$—(PO)x-(EO)y-$R^2$ (Formula (II)), $R^1O$-(EO)o-(PO)p-(EO)q-$R^2$ (Formula (III)), and $R^1O$—(PO)o-(EO)p-(PO)q-$R^2$ (Formula (IV)), or a combination thereof, wherein EO is a —$CH_2CH_2O$— group, and PO is a —$CH(CH_3)CH_2O$— group; $R^1$ and $R^2$ independently is H or a $C_1$-$C_{22}$ alkyl group; x, y, o, p, and q are independently 1-100; provided that the sum of x and y is greater than 35, and the sum of o, p and q is greater than 35.

In some embodiments is provided a solid composition for fabric treatment prepared by a process comprising mixing and melting a polyethylene glycol and/or a block copolymer (e.g., copolymers of Formula (I) through (IV) described herein), and a dry powder of encapsulated fragrance to form a mixture, shaping or allowing the mixture to shape; and hardening the shaped mixture.

In some embodiments, the solid composition for fabric treatment is spherical, hemi-spherical, lentil shaped, or oblong shaped.

In one embodiment, the solid composition for fabric treatment further comprises an encapsulated fragrance slurry, a free fragrance, a colorant, a glycol fatty acid ester, a filler, or a combination thereof.

In some embodiments, the fragrance can be selected from the group consisting of an ester, an ether, an aldehyde, a ketone, an alcohol, a hydrocarbon, or a combination thereof.

In other embodiments, the colorant is a water-soluble polymer, water-insoluble polymer, a water-soluble dye, a water-insoluble dye, or a combination thereof.

In some embodiments, the glycol fatty acid ester is a glycol monostearate or a glycol distearate. In one embodiment, the glycol fatty acid ester is ethylene glycol monostearate.

In some embodiments, the solid composition for fabric treatment can be in the form selected from the group comprising a pastille, a granule, a pellet, a powder, a pulverized powder, a tablet, or a crystal.

In some embodiments is provided a process of making a solid composition for fabric treatment comprising mixing and melting a polyethylene glycol and/or a block copolymer (e.g., copolymers of Formula (I) through (IV) described herein), with a dry powder of encapsulated fragrance to form a mixture, aerating the molten mixture to incorporate a sufficient amount of air or gaseous material into the mixture, shaping or allowing the aerated mixture to shape, and hardening the shaped mixture.

In some embodiments is provided a process of making a solid composition for fabric treatment, further comprising cooling the mixture to a processing temperature above the glass transition temperature of the mixture and below the melting temperature of the mixture.

In a further embodiment is provided a unit dose fabric treatment composition comprising the solid composition for fabric treatment of the present disclosure. The unit dose can further contain sodium chloride, fragrance, or a combination thereof. The unit dose can deliver fragrance to a textile, deliver fabric care to a textile, clean a textile, or combinations thereof. In certain such embodiments, the unit dose is suitable for addition to a washing machine at the beginning of the wash cycle.

In a further embodiment is provided a process of delivering fragrance or fabric care to a textile, cleaning a textile, applying a fragrance to a fabric or a textile, or combinations thereof, comprising contacting the textile with a solid composition for fabric treatment.

In some embodiments is provided a solid composition for fabric treatment prepared by a process comprising mixing and melting a polyethylene glycol and/or block copolymers (e.g., copolymers of Formula (I) through (IV) described herein), a dry powder of encapsulated, a free fragrance, and a colorant to form a mixture, shaping or allowing the mixture to shape, and hardening the shaped mixture.

DETAILED DESCRIPTION OF THE INVENTION

Definitions

All of the various aspects, embodiments, and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing" and the like mean "comprising."

The act of treating a textile can refer to, for example, one or more of: i) applying a perfume to a textile; ii) softening a textile; iii) applying a perfume to and softening a textile; iv) cleaning a textile; v) rendering the textile resistant to static build up during drying; or vi) cleaning a textile and applying a perfume to and softening a textile and rendering the textile resistant to static build up during drying; or any combination thereof.

The term "or" can be conjunctive or disjunctive.

Some inventive embodiments contemplate numerical ranges. Every numerical range provided herein includes the range endpoints as individual inventive embodiments. When a numerical range is provided, all individual values and sub-ranges therein are present as if explicitly written out.

The term "about" includes the recited number ±10%. For example, "about 10" means 9 to 11.

The terms "textile" and "fabric" can be used interchangeably.

The terms "fragrance" and "perfume" can be used interchangeably.

The terms "process" and "method" can be used interchangeably.

The term "free fragrance" means fragrance which is not encapsulated.

The phrase "substantially free of" means that a composition contains little no specified ingredient/component, such as less than about 5% by weight, less than about 4% by weight, less than about 3% by weight, less than about 2% by weight, or less than about 1% by weight of the specified ingredient. For example, the phrase "substantially free of block copolymer" refers to a composition of the present disclosure that contains little or no block copolymer. A composition of the present disclosure substantially free of block copolymer may comprise, for example, less than about 5% block copolymer by weight, or less than about 4% block copolymer by weight, or less than about 3% block copolymer by weight, or less than about 2% block copolymer by weight, or less than about 1% block copolymer by weight, based on the total weight of the composition.

The term "aerating" denotes entrapping or incorporating air or gaseous material into a composition by any suitable means.

Air or gaseous material is "entrapped" or "incorporated" into a composition by adding air or gaseous material to the composition while the composition is in a liquid, melted, or molten form.

The term "processing temperature" refers to the temperature at which a molten mixture of ingredients, as disclosed herein, is cooled to prior to solidification.

The term "melting temperature" refers to the temperature at which a composition converts from a solid form to a liquid form.

The term "glass transition temperature" refers to a temperature at which a transition from a liquid to a solid-like state occurs upon cooling. The glass transition temperature of a composition is below its melting temperature.

Compositions for Fabric Treatment ("SCFTs")

The present disclosure provides a solid composition for fabric treatment. The SCFTs can be used, for example to treat a textile.

The SCFTs of the present disclosure are desirably solid at room temperature (e.g., about 25° C.) and are soluble in cold, warm, and hot water, and can deliver long lasting fragrance impression.

In one embodiment, the SCFTs solubilize in about 15 minutes or less, or about 14 minutes or less, or about 13 minutes or less, or about 12 minutes or less, or about 11 minutes or less, or about 10 minutes or less, or about 9 minutes or less, or about 8 minutes or less, as measured by a stir-bar method at 59° F. in 120 ppm $Ca^{2+}/Mg^{2+}$ water, wherein the ratio of $Ca^{2+}:Mg^{2+}$ is 3:1.

The water solubility can be measured by methods known in the art by a person of ordinary skill in the art. The water solubility can be measured, for example, by stir-bar method at 59° F. in 120 ppm $Ca^{2+}/Mg^{2+}$ water, wherein the ratio of $Ca^{2+}:Mg^{2+}$ is about 3:1.

In another embodiment is provided a SCFT having a strength ranging from about 5 Newtons to about 50 Newtons, about 7 Newtons to about 35 Newtons, or about 9 Newtons to about 35 Newtons of required force to break the solid composition.

In one embodiment, the present disclosure provides a process of making a SCFT that comprises forming a mixture by mixing and melting (a) a polyethylene glycol (PEG), and (b) a dry powder of encapsulated fragrance; shaping or allowing the mixture to shape, and hardening the mixture; wherein the polyethylene glycol is present in an amount of from about 50% by weight to about 99% by weight, or about 60% by weight to about 97% by weight, or about 70% by weight to about 97% by weight, or about 80% by weight to about 97% by weight, or about 60% by weight to about 95% by weight, about 70% by weight to about 95% by weight, about 80% by weight to about 95% by weight of the composition.

In another embodiment, the present disclosure provides a SCFT that comprises (a) a polyethylene glycol (PEG), and (b) a fragrance provided by a dry powder of encapsulated fragrance; wherein the polyethylene glycol is present in an amount of from about 50% by weight to about 99% by weight, or about 60% by weight to about 97% by weight, or about 70% by weight to about 97% by weight, or about 80% by weight to about 97% by weight, or about 60% by weight to about 95% by weight, about 70% by weight to about 95% by weight, about 80% by weight to about 95% by weight of the composition.

In one embodiment, the present disclosure provides a process of making a SCFT that comprises forming a mixture by mixing and melting (a) a block copolymer, and (b) a dry powder of encapsulated fragrance; shaping or allowing the mixture to shape, and hardening the mixture; wherein the block copolymer is present in an amount of from about 50% by weight to about 99% by weight, or about 75% by weight to about 99% by weight, or about 75% by weight to about 90% by weight, or about 80% by weight to about 95% by weight, or 75% by weight to about 85% by weight of the composition.

In another embodiment, the present disclosure provides a SCFT that comprises (a) a block copolymer, and (b) a fragrance provided by a dry powder of encapsulated fragrance; wherein the block copolymer is present in an amount of from about 50% by weight to about 99% by weight, or about 75% by weight to about 99% by weight, or about 75% by weight to about 90% by weight, or about 80% by weight to about 95% by weight, or 75% by weight to about 85% by weight of the composition.

In one embodiment, the present disclosure provides a process of making a SCFT that comprises forming a mixture by mixing and melting (a) a polyethylene glycol (PEG), (b) a block copolymer, and (c) a dry powder of encapsulated fragrance; shaping or allowing the mixture to shape, and hardening the mixture; wherein the polyethylene glycol is present in an amount of from about 50% by weight to about 99% by weight, or about 60% by weight to about 97% by weight, or about 70% by weight to about 97% by weight, or about 80% by weight to about 97% by weight, or about 60% to about 95% by weight, about 70% to about 95% by weight, about 80% to about 95% by weight of the composition; and wherein the block copolymer is present in an amount of about 5% by weight to about 50% by weight, or about 10% by weight to about 40% by weight, or about 15% by weight to about 35% by weight, or about 20% to about 30% of the composition.

In another embodiment, the present disclosure provides a SCFT that comprises (a) a polyethylene glycol (PEG), (b) a block copolymer, and (c) a fragrance provided by a dry powder of encapsulated fragrance; wherein the polyethylene glycol is present in an amount of from about 50% by weight to about 99% by weight, or about 60% by weight to about 97% by weight, or about 70% by weight to about 97% by weight, or about 80% by weight to about 97% by weight, or about 60% to about 95% by weight, about 70% to about 95% by weight, about 80% to about 95% by weight of the composition; and wherein the block copolymer is present in an amount of about 5% by weight to about 50% by weight, or about 10% by weight to about 40% by weight, or about 15% by weight to about 35% by weight, or about 20% to about 30% of the composition.

In another embodiment, the present disclosure provides a SCFT prepared by the processes described herein.

The block copolymer can comprise polymers having the Formulae (I) through (IV): $R^1O$-(EO)x-(PO)y-$R^2$ (Formula (I)), $R^1O$—(PO)x-(EO)y-$R^2$ (Formula (II)), $R^1O$-(EO)o-(PO)p-(EO)q-$R^2$ (Formula (III)), and $R^1O$—(PO)o-(EO)p-(PO)q-$R^2$ (Formula (IV)), or a combination thereof.

The fragrance can be present in an amount of from about 0.01% by weight to about 25% by weight, or about 0.01% by weight to about 20% by weight, or about 0.01% by weight to about 15% by weight, or about 0.1% by weight to about 12% by weight, or about 1% by weight to about 10% by weight. In one embodiment, the fragrance provided by the dry powder of encapsulated fragrance is present in an amount from about 0.01% by weight to about 15% by weight, or about 0.01% by weight to about 10% by weight, or about 0.1% by weight to about 10%, or about 1% by weight to about 9% by weight, or about 2% by weight to about 9% by weight of the composition.

In some embodiments, the fragrance is an ester, an ether, an aldehyde, a ketone, an alcohol, a hydrocarbon, or a combination thereof.

In some embodiments, the encapsulated fragrance is provided in a microcapsule having a melamine/formaldehyde shell.

In some embodiments, the SCFT can further comprise fragrance provided by an encapsulated fragrance slurry, a free fragrance, or a combination thereof. In one embodiment, the free fragrance is present in an amount from about 0.01% by weight to about 15% by weight, or about 0.01% by weight to about 10% by weight, or about 0.01% by weight to about 7% by weight, or about 0.01% by weight to about 5% by weight of the composition. In another embodiment, encapsulated fragrance slurry is present in an amount from about 0.01% by weight to about 15% by weight, or about 0.01% by weight to about 10% by weight, or about 0.1% by weight to about 8% by weight, or about 1% by weight to about 6% by weight, or about 2% by weight to about 6% by weight of the composition.

In some embodiments, the SCFT can further comprise a colorant, a glycol fatty acid ester, a filler or a mixture thereof. The SCFT can further include other additives commonly included in a fabric treatment composition.

In some embodiments, the glycol fatty acid ester is a glycol monostearate or a glycol distearate. In one embodiment, the glycol fatty acid ester is ethylene glycol monostearate.

In one embodiment is provided a SCFT having a melting point ranging from about 48° C. to about 67° C., about 50° C. to about 65° C., about 52° C. to about 63° C., or about 54° C. to about 61° C. In a further embodiment, the melting point of the composition is at least about 2° C., at least about 4° C., at least about 6° C., or at least about 8° C. higher than a reference composition made with encapsulated fragrance slurry and/or free fragrance and without a dry powder of encapsulated fragrance.

In one embodiment, the SCFT is stable at about 51.7° C. for at least about 4 weeks, or at least about 8 weeks, stable at about 40.6° C. for at least about 8 weeks, or at least about 12 weeks, or stable at about 4.4° C. for at least about 2 months, at least about 4 months.

The ingredients in the SCFT can be homogeneously or heterogeneously mixed. In some embodiments, the ingredients in the SCFT are homogeneously mixed.

Fragrance(s) or Perfume(s)

In some embodiments, the SCFT comprises a polyethylene glycol and/or a block copolymer and fragrance provided by a dry powder of encapsulated fragrance.

In some embodiments, the SCFT can further comprise an encapsulated fragrance slurry, a free fragrance, or a combination thereof.

In some embodiments, the dry powder of encapsulated fragrance or the encapsulated fragrance slurry is in a microcapsule or a nanocapsule. The microcapsules and nanocapsules can be water-soluble or water-insoluble. Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

Fragrance (perfume) refers to and includes any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance or perfume can be an ester, an ether, an aldehyde, a ketone, an alcohol, a hydrocarbon, or a combination thereof.

The fragrance or perfume can have, for example, a musky scent, a putrid scent, a pungent scent, a camphoraceous scent, an ethereal scent, a floral scent, a peppermint scent, or any combination thereof.

In one embodiment, the fragrance or perfume can comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In one embodiment, the fragrance or perfume can contain, for example, a linear terpene, a cyclic terpene, an aromatic compound, a lactone, a thiol, or any combination thereof.

In one embodiment, the fragrance or perfume is High Five ACM 190991 F (Firmenich), Super Soft Pop 190870 (Firmenich), Mayflowers TD 485531 EB (Firmenich), Popscent 259366 (Firmenich), Azulete Neat Oil 495389 (Firmenich), Swisspop 290437 (Firmenich), Swisspop 290438 (Firmenich), Swisspop 290439 (Firmenich), Swisspop 290440 (Firmenich), Swisspop 290441 (Firmenich), Freshwave 247210V (Firmenich), Patera Rosa 256417DB (Firmenich), or any combination thereof. Other art-known fragrances, or any fragrance commercially available from a fragrance supplier (e.g. Firmenich, Givaudan, International Flavors and Fragrances (IFF), Oriental etc.), or combinations of such fragrances, may also suitably be used in the SCFTs, compositions, and methods disclosed herein.

The total amount of fragrance or perfume in the SCFT can range, for example, from about 0.1% by weight to about 25.0% by weight, or from about 0.1% by weight to about 15% by weight, based on the total weight of the SCFT. In some embodiments, the total amount of fragrance is in an amount of from about 0.01% by weight to about 15% by weight, or about 0.1% by weight to about 12% by weight, or about 1% by weight to about 10% by weight, based on the total weight of the SCFT.

The amount of fragrance in the SCFT provided by the dry powder of encapsulated fragrance can range from about 0.01% by weight to about 15% by weight, or about 0.01% by weight to about 10% by weight, or about 0.1% by weight to about 10% by weight, or about 1% by weight to about 9% by weight, or about 2% by weight to about 9% by weight, based on the total weight of the SCFT.

The amount of fragrance in the SCFT provided by the free fragrance or perfume in the SCFT can range from about 0.01% by weight to about 20% by weight, from about 0.01% by weight to about 15% by weight, or from about 0.01% by weight to about 10% by weight, or about 0.01% by weight to about 7% by weight, or about 0.01% by weight to about 5%, or from about 0.01% by weight to about 2.5% by weight, based on the total weight of the SCFT.

The amount of fragrance in the SCFT provided by the encapsulated fragrance slurry in the SCFT can range from about 0.01% by weight to about 15% by weight, or about 0.01% by weight to about 10% by weight, or about 0.1% by weight to about 8% by weight, or about 1% by weight to about 6% by weight, or about 2% by weight to about 6% by weight, based on the total weight of the SCFT. The weight percent as used herein for the encapsulated fragrance slurry is based on the total weight of the SCFT and applies to the encapsulated fragrance slurry used to make the SCFT, including the water.

In some embodiments, the encapsulated fragrance slurry comprises from about 10% by weight to about 80% by weight fragrance and from about 20% by weight to about 90% by weight water, based on the total weight of the encapsulated fragrance slurry. In one embodiment, the encapsulated fragrance is an encapsulated fragrance slurry comprising about 30% by weight fragrance and about 70% by weight water.

PEG(s)

The PEG can have a weight average molecular weight (g/mol) ranging, for example, from about 1000 to about 10,000,000. Suitable PEGs can have a weight average molecular weight of, for example, about 1,000, about 1,500, about 2,000, about 2,500, about 3,000, about 3,500, about 4,000, about 4,500, about 5,000, about 6,000, about 7,000, about 8,000, about 9,000, about 10,000, about 11,000, about 15,000, about 20,000, about 25,000, about 30,000, about 35,000, about 40,000, about 45,000, about 50,000, about 55,000, about 60,000, about 65,000, about 70,000, about 75,000, about 80,000, about 85,000 about 90,000, about 95,000, about 100,000, about 200,000, about 300,000, about 400,000, about 500,000, about 600,000, about 700,000, about 800,000, about 900,000, about 1,000,000, about 2,000,000, about 3,000,000, about 4,000,000, about 5,000,000, about 6,000,000, about 7,000,000, about 8,000,000, about 9,000,000 or about 10,000,000.

In some embodiments, the PEG can have an average molecular weight from about 1000 to about 10,000, or about 1000 to about 8500, from about 2000 to about 6000, or from about 2000 to about 4500. In one embodiment, the PEG has an average molecular weight of about 4000.

Exemplary PEGs include, for example, PEG 1,000, PEG 2,000, PEG 3,000, PEG 3,350, PEG 3500, PEG 4,000, PEG 4,500, PEG 5,000, PEG 6,000, PEG 7,000, PEG 8,000, or combinations and mixtures thereof.

Exemplary PEG include, but are not limited to, CARBOWAX™ PEGs (Dow Chemical), such as CARBOWAX™ 1000, CARBOWAX™ 1450, CARBOWAX™ 3350, CARBOWAX™ 4000, CARBOWAX™ 4600, CARBOWAX™ 8000, or combinations thereof.

The total amount of the one or more PEGs contained in the SCFT, for example, can range from about 30% by weight to about 99% by weight, or about 40% by weight to about 99% by weight, or about 50% by weight to about 99% by weight, or about 60% by weight to about 99% by weight, or about 70% by weight to about 99% by weight, or about 80% by weight to about 99% by weight, or about 60% by weight to about 97% by weight, or about 70% by weight to about 97% by weight, or about 80% by weight to about 97% by weight, or about 60% by weight to about 95% by weight, or about 70% by weight to about 95% by weight, or about 80% by weight to about 95% by weight, or about 60% by weight to about 90% by weight, or about 70% by weight to about 90% by weight, about 80% by weight to about 90% by weight, based on the total weight of the SCFT.

The total amount of the one or more PEGs can be, for example, about 50% by weight, or about 51% by weight, or about 52% by weight, or about 53% by weight, or about 54% by weight, or about 55% by weight, or about 56% by weight, or about 57% by weight, or about 58% by weight, or about 59% by weight, or about 60% by weight, or about 61% by weight, or about 62% by weight, or about 63% by weight, or about 64% by weight, or about 65% by weight, or about 66% by weight, or about 67% by weight, or about 68% by weight, or about 69% by weight, or about 70% by weight, or about 71% by weight, or about 72% by weight, or about 73% by weight, or about 74% by weight, or about 75% by weight, or about 76% by weight, or about 77% by weight, or about 78% by weight, or about 79% by weight, or about 80% by weight, or about 81% by weight, or about 82% by weight, or about 83% by weight, or about 84% by weight, or about 85% by weight, or about 86% by weight, or about 87% by weight, or about 88% by weight, or about 89% by weight, or about 90% by weight, or about 91% by weight, or about 92% by weight, or about 93% by weight, or about 94% by weight, or about 95% by weight, or about 96% by weight, or about 97% by weight, or about 98% by weight, or about 99% by weight, based on the total weight of the SCFT.

In one embodiment, the SCFT is substantially free of a PEG.

Block Copolymer(s)

The block copolymer of the present disclosure can be a block copolymer of Formula (I) through (IV):

$$R^1O\text{-}(EO)x\text{—}(PO)y\text{-}R^2 \quad \text{(I)},$$

$$R^1O\text{—}(PO)x\text{-}(EO)y\text{-}R^2 \quad \text{(II)},$$

$$R^1O\text{-}(EO)o\text{—}(PO)p\text{-}(EO)q\text{-}R^2 \quad \text{(III)},$$

$$R^1O\text{—}(PO)o\text{-}(EO)p\text{—}(PO)q\text{-}R^2 \quad \text{(IV)},$$

or a combination thereof, wherein EO is a —$CH_2CH_2O$— group, and PO is a —$CH(CH_3)CH_2O$— group;

$R^1$ and $R^2$ can independently be H or a $C_1$-$C_{22}$ alkyl group, x, y, o, p, and q can independently be 1-100, and provided that the sum of x and y is greater than 35, and the sum of o, p, and q is greater than 35.

In one embodiment, the block copolymer has Formula (I) or (II), or a combination thereof, and wherein the ratio of x:y ranges from 1.5:1 to about 10:1, about 2:1 to about 10:1, about 2:1 to about 8:1, about 3:1 to about 8:1, about 3:1 to about 5:1; about 4:1 to about 6:1, or about 4:1, about 3:1, or about 2:1.

In one embodiment, the block copolymer has Formula (III) or (IV), or a combination thereof, and wherein the ratio of (o+q):p ranges from about 1.5:1 to about 10:1, about 2:1 to about 10:1, about 2:1 to about 8:1, about 3:1 to about 8:1, about 3:1 to about 5:1; about 4:1 to about 6:1, or about 4:1, about 3:1, or about 2:1.

A combination of block copolymers includes two or more block copolymers having different Formulae (I), (II), (III), or (IV), or two or more block copolymers having the same Formulae (I), (II), (III), or (IV).

In one embodiment, $R^1$ and $R^2$ are independently H. In one embodiment $R^1$ and $R^2$ are independently a $C_1$-$C_{22}$ alkyl group, a $C_1$-$C_{12}$ alkyl group, a $C_1$-$C_8$ alkyl group, or a $C_1$-$C_4$ alkyl group.

The block copolymer(s) can have, individually, a hydrophilic-lipophilic-balance value (HLB), for example, ranging from about 15 to about 35.

The HLB can be calculated, for example, using the methodology of Griffin or Davies (Griffin, W. C., "Classification of Surface-Active Agents by 'HLB'," *J. Soc. Cosmetic Chemists* 1:311 (1949); Davies, J. T., "A Quantitative Kinetic Theory of Emulsion Type, I. Physical Chemistry of the Emulsifying Agent," Gas/Liquid and Liquid/Liquid Interface, *Proceedings the International Congress of Surface Activity* 426-438 (1957). Davies' methodology is useful for calculating higher HLB values. Alternatively, McCutcheon's Emulsifiers and Detergents provide HLB values for commercially available nonionic surfactants.

The block copolymer(s) can have, for example, individually, an HLB ranging from about 15 to about 35, from about 17 to about 35, from about 19 to about 35, from about 21 to about 35, from about 23 to about 35, from about 24 to about 35, from about 25 to about 35, from about 26 to about 35, from about 27 to about 35, from about 29 to about 35, from about 31 to about 35, from about 35 to about 15, from about 33 to about 15, from about 31 to about 15, from about 29 to about 15, from about 27 to about 15, from about 25 to about 15, from about 23 to about 15, from about 21 to about 15, from about 17 to about 33, from about 18 to about 32, from about 19 to about 31, from about 20 to about 30, from about 21 to about 29, from about 22 to about 28, or from about 23 to about 27.

The block copolymer(s) can have, for example, individually, an HLB of at least 15, at least 17, at least 20, at least 22, at least 24, at least 25, at least 26, at least 28, at least 30, at least 32, or at least 35. The block copolymer(s) can have, for example, individually, an HLB about 20, 21, 22, 23, 24 or 25.

The block copolymer(s) can have, individually, a weight average molecular weight (g/mol) ranging, for example, from about 3,000 to about 12,000. The weight average molecular weight can range, for example, from about 3,500 to about 12,000, from about 4,000 to about 12,000, from about 4,500 to about 12,000, from about 5,000 to about 12,000, from about 5,500 to about 12,000, from about 6,000 to about 12,000, from about 6,500 to about 12,000, from about 7,000 to about 12,000, from about 7,500 to about 12,000, from about 8,000 to about 12,000, from about 8,500 to about 12,000, from about 9,000 to about 12,000, from about 9,500 to about 12,000, from about 10,000 to about 12,000, from about 10,500 to about 12,000, from about 11,000 to about 12,000, from about 11,500 to about 12,000, from about 11,500 to about 3,000, from about 11,000 to about 3,000, from about 10,500 to about 3,000, from about 10,000 to about 3,000, from about 9,500 to about 3,000, from about 9,000 to about 3,000, from about 8,500 to about 3,000, from about 8,000 to about 3,000, from about 7,500 to about 3,000, from about 7,000 to about 3,000, from about 6,500 to about 3,000, from about 6,000 to about 3,000, from about 5,500 to about 3,000, from about 5,000 to about 3,000, from about 4,500 to about 3,000, from about 4,000 to about 3,000, from about 3,500 to about 3,000, from about 3,200 to about 11,400, from about 3,500 to about 11,000, from about 4,000 to about 10,500, from about 4,000 to about 9,500, from about 4,500 to about 9,500, from about 4,700 to about 8,400, or from about 5,500 to about 7,000.

The block copolymer(s) can comprise a mixture of at least two block copolymers of Formula (I), or at least two block copolymers of Formula (II), or at least two block copolymers of Formula (III), or at least two block copolymers of Formula (IV).

The block copolymer(s) can comprise a mixture of at least one block copolymer of Formula (I) and at least one block copolymer of Formula (II), or at least one block copolymer of Formula (I) and at least one block copolymer of Formula (III), or at least one block copolymer of Formula (I) and at least one block copolymer of Formula (IV), or at least one block copolymer of Formula (II) and at least one block copolymer of Formula (III), or at least one block copolymer of Formula (II) and at least one block copolymer of Formula (IV), or at least one block copolymer of Formula (III) and at least one block copolymer of Formula (IV).

The block copolymer(s) can comprise a mixture of two or more block copolymers having the same formula or different formulae, wherein one block copolymer has a weight average molecular weight (g/mol) ranging from about 3,000 to about 7,500, or from about 3,000 to about 6,000, or from about 4,000 to about 5,000, and another block copolymer has a weight average molecular weight (g/mol) ranging from about 6,000 to about 11,000, or from about 7,000 to about 10,000, or from about 8,000 to about 9,000. In one embodiment, the block copolymers can comprise a mixture of two or more block copolymers having the same formula or different formulae, wherein one block copolymer has a weight average molecular weight (g/mol) ranging from about 4,000 to about 5,000, and another block copolymer has a weight average molecular weight (g/mol) ranging from about 8,000 to about 9,000.

In one embodiment, the block copolymer(s) can comprise a mixture of two or more block copolymers wherein the two or more block copolymers each have a weight average molecular weight ranging from about 3,000 to about 10,000, or from about 4,000 to about 9000.

In one embodiment, the block copolymer comprises a mixture of at least two block copolymers of Formula (III), wherein one block copolymer has a molecular weight (g/mol) ranging from about 4000 to about 5000, and the other block copolymer has a molecular weight ranging from about 8000 to about 9000. In one preferred embodiment, the two block copolymer each have a molecular weight ranging from about 4000 to about 9000. In one preferred embodiment, the ratio of the block copolymer having a molecular weight ranging from about 4000 to about 5000 to the block copolymer having a molecular weight ranging from about 8000 to about 9000 ranges from about 1:3 to about 1:12, from about 1:5 to about 1:12, or from about 1:7 to about 1:10.

The mixture of two or more block copolymers can comprise two block copolymers having different molecular weight. For example, the mixture of two or more block copolymers can have a ratio of a lower molecular weight block copolymer to a higher molecular weight block copolymer ranging from about 1:1 to about 1:15, or about 1:3 to about 1:12, or about 1:5 to about 1:12, or about 1:7 to about 1:10. In one embodiment, the mixture of two or more block copolymers can comprise a ratio of a lower molecular weight block copolymer to a higher molecular weight block copolymer ranging from about 15:1 to about 1:1, or about 12:1 to about 5:1, or about 10:1 to about 7:1.

Exemplary block copolymer(s) include, but are not limited to, PLURONIC®-F38 (BASF), PLURONIC®-F48 (BASF), PLURONIC®-F58 (BASF), PLURONIC®-F68 (BASF), PLURONIC®-F77 (BASF), PLURONIC®-F87 (BASF), PLURONIC®-F88 (BASF), and combinations thereof.

In some embodiments, the SCFT can contain the block copolymer(s) in a total amount ranging from about 40% by weight to about 99% by weight, based on the weight of the SCFT. In some embodiments, the SCFT can contain the block copolymer(s) in an amount ranging from about 55% by weight to about 99% by weight, from about 60% by weight to about 99% by weight, from about 65% to about 99% by weight, from about 70% to about 99% by weight, from about 75% by weight to about 99% by weight, from about 80% by weight to about 99% by weight, from about 85% by weight to about 99% by weight, from about 70% by weight to about 95% by weight, from about 75% by weight to about 95% by weight, from about 80% by weight to about 95% by weight, from about 85% by weight to about 95% by weight, from about 70% by weight to about 90% by weight, from about 75% by weight to about 90% by weight, from about 80% by weight to about 90% by weight, or from about 75% by weight to about 85% by weight, based on the weight of the SCFT; wherein the SCFT is substantially free of a PEG.

In some embodiments, the SCFT can contain the block copolymer(s) in a total amount ranging from about 1% by weight to about 60% by weight, based on the weight of the SCFT. In some embodiments, the SCFT can contain the block copolymer(s) in an amount ranging from about 5% by weight to about 50% by weight, from about 10% by weight to about 50% by weight, from about 20% by weight to about 50% by weight, from about 30% by weight to about 50% by weight, from about 40% by weight to about 50% by weight, from about 5% by weight to about 45% by weight, from about 10% by weight to about 40% by weight, from about 15% by weight to about 35% by weight, from about 20% by weight to about 30% by weight, based on the weight of the SCFT; wherein the SCFT also contains a PEG. In another embodiment, the SCFT can contain the block copolymer(s) in a total amount of up to about 60% by weight, or up to about 50% by weight, or up to about 40% by weight, or up to about 35% by weight, or up to 30% by weight, or up to about 25% by weight, based on the weight of the SCFT; wherein the SCFT comprises a PEG.

In some embodiments, the SCFT comprises both PEG and a block copolymer(s) at a weight ratio of PEG:block copolymer(s) ranging from about 50:1 to about 1:1, or about 40:1 to about 1:1, or about 30:1 to about 1:1, or about 20:1 to about 1:1, or about 15:1 to about 1:1, or from about 10:1 to about 1:1, or from about 5:1 to about 1:1, or from about 4:1 to about 1:1, or from about 3:1 to about 1:1, or from 2:1 to about 1:1, or about 4:1, or about 3:1, or about 2:1. In one embodiment, the weight ratio of PEG:block copolymer(s) is about 3:1. In another embodiment, the weight ratio of PEG:block copolymer(s) is about 2:1.

In one embodiment, the SCFT is substantially free of a block copolymer.

Colorant(s)

In some embodiments, the SCFT does not contain a colorant.

In some embodiments, the SCFT contains one or more colorants, for example, polymers, dyes, water-soluble polymers, water-soluble dyes, water-insoluble polymers, water-insoluble dyes, or a mixture thereof.

The colorant(s) include those that are known in the art, or commercially available from dye or chemical manufacturers.

The color of the colorant(s) is not limited, and can be, for example, red, orange, yellow, green, blue, indigo, violet, or any combination thereof.

The colorant(s) can be, for example, one or more Milliken LIQUITINT® colorants: VIOLET LS, ROYAL MC, BLUE HP, BLUE MC, AQUAMARINE, GREEN HMC, BRIGHT YELLOW, YELLOW LP, YELLOW BL, BRILLIANT ORANGE, CRIMSON, RED MX, PINK AL, RED BL, RED ST, or any combination thereof.

The colorant(s) can be, for example, one or more of Acid Blue 80, Acid Red 52, and Acid Violet 48, or any combination thereof.

Acid Blue 48 has the chemical structure:

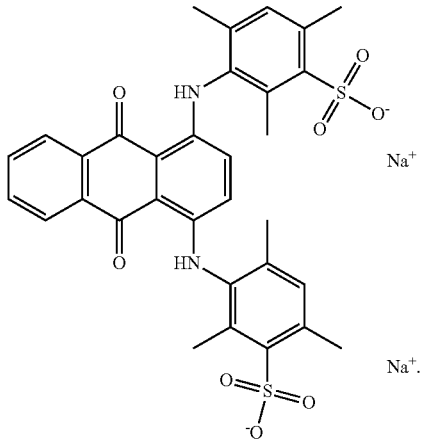

Acid Red 52 has the chemical structure:

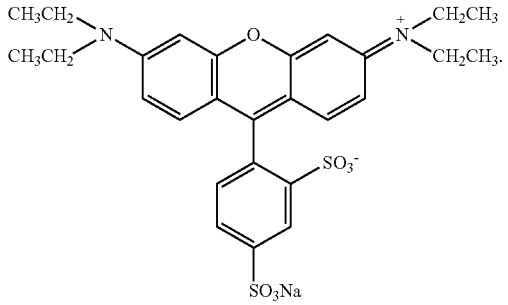

Acid Violet 48 has the chemical structure:

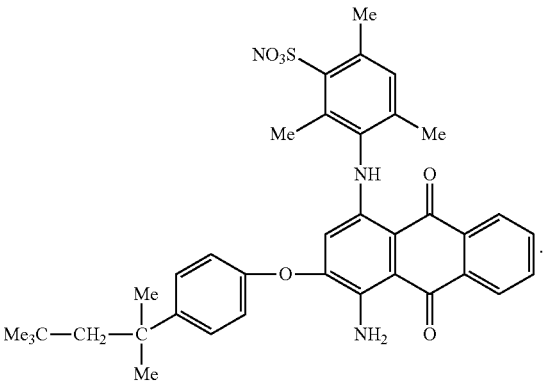

The total amount of the one or more colorant(s) that can be included in the SCFT, for example, can range from about 0.00001% by weight to about 0.15% by weight, from about 0.0001% by weight to about 0.1% by weight, from about 0.001% by weight to about 0.1% by weight, or from about 0.005% by weight to about 0.1% by weight, based on the total weight of the SCFT. The total amount of colorant(s) in the SCFT can be, for example, about 0.0001% by weight, about 0.001% by weight, about 0.01% by weight, about 0.05% by weight, about 0.08% by weight, or about 0.1% by weight, based on the total weight of the SCFT.

Glycol Fatty Acid Ester(s)

The glycol fatty acid ester(s) of the present disclosure can comprise a fatty acid portion having a carbon chain length ranging from about 8 carbons to about 25 carbons, from about 8 carbons to about 24 carbons, from about 10 carbons to about 22 carbons, from about 12 carbons to about 20 carbons, or from about 14 carbons to about 18 carbons.

In some embodiments, the glycol fatty acid ester(s) can comprise a fatty acid portion having a saturated carbon chain. In other embodiments, the glycol fatty acid ester(s) can comprise a fatty acid portion having a mono or polyunsaturated carbon chain.

In some embodiments, the glycol fatty acid ester is a monoester. In other embodiments, the glycol fatty acid ester is a diester.

In some embodiments, the glycol fatty acid ester is a glycol stearate, e.g. a glycol monostearate or a glycol distearate.

In some embodiments, the glycol portion of the glycol fatty acid ester has from about 1 carbon to about 8 carbons, from about 2 carbons to about 5 carbons, or from about 2 carbons to about 4 carbons. In other embodiments, the glycol portion of the glycol fatty acid ester is an ethylene glycol. In further embodiments, the glycol portion of the glycol fatty acid ester is an ethylene glycol or a propylene glycol.

In one preferred embodiment, the glycol fatty acid ester is ethylene glycol monostearate.

In some embodiments, the SCFT can contain, for example, a total amount of glycol fatty acid ester ranging from about 0.05% by weight to about 25% by weight, from about 0.05% by weight to about 20% by weight, from about 0.1% by weight to about 15% by weight, from about 0.5% by weight to about 10% by weight, or from about 1% by weight to about 8% by weight, based on the total weight of the SCFT.

In some embodiments, the ratio of block copolymer(s) to glycol fatty acid ester ranges from about 75:12 to 84:1, or from about 80:7 to 83:2. In one embodiment, the ratio of block copolymer(s) to glycol fatty acid ester of about 82:5.

In another embodiment, the SCFT is substantially free of PEG, PEG fatty acid esters, PEG stearates, and/or glycerol stearates.

Filler(s)

In some embodiments, the SCFT does not contain a filler.

In some embodiments, the SCFT contains one or more fillers, for example, a clay. In one embodiment, the clay is a smectite clay, e.g., a Bentonite clay, Beidellite clay, a Hectorite clay, a Laponite clay, a Montmorillonite clay, a Nontronite clay, a Saponite clay, a Sauconite, clay, or any combination thereof. In one embodiment, the clay is a Bentonite clay.

In other embodiments, the filler can be a starch material. The starch material can comprise starch derived from corn, potato, tapioca, cereal grain, rice, beans, peas or a combination thereof. Cereal grain includes, but is not limited to, corn, rice, wheat, barley, sorghum, millet, oats, rye, and combinations thereof.

The total amount of the one or more filler(s) that can be contained in the SCFT, for example, can be up to about 40% by weight, or can range from about 0.001% by weight to about 30% by weight, about 0.01% by weight to about 25% by weight, about 0.1% by weight to about 20% by weight, or about 1% by weight to about 15% by weight, based on the total weight of the SCFT.

Additional Ingredient(s)

In some embodiments, the SCFT may further comprise additional ingredient(s) known to be employed in compositions for fabric treatment.

The additional ingredient(s) can be, for example, a bleaching agent, a bleach activator, an enzyme, a silicone oil, an anti-re-deposition agent, an optical brightener, a greying inhibitor, a shrink inhibitor, an anti-creasing agent, a color transfer inhibitor, an anti-microbial, a germicide, a fungicide, an antioxidant, an anti-static agent, an ironing aid, a water proofing agent, an impregnation agent, a swelling agent, an anti-slip agent, a UV absorber, a corrosion inhibitor, or any combination thereof. In other embodiments, the additive can be one or more viscosity-modifying agents (e.g., silica, sodium CMC, and other agents well-known in the art to increase or decrease the viscosity of a liquid or liquid-containing suspension), one or more opacifying agents, and the like. In further embodiments, the additional ingredient(s) can be scavengers, including, for example, chlorine scavengers.

The additional ingredient(s) can be, for example, a salt. Salts can include, but are not limited to, alkali metal salt, alkaline earth metal salt, and combinations thereof.

Alkali metal salts can be, for example, salts of lithium, sodium, potassium, rubidium, cesium, francium, or any combination thereof.

Useful alkali metal salts can be, for example, alkali metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkali metal salts can include, for example, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium ascorbate, or any combination thereof.

Alkaline earth metal salts include, for example, salts of beryllium, magnesium, calcium, strontium, barium, radium, or any combination thereof.

Alkaline earth metal salts can be, for example, alkaline metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkaline earth metal salts can include, for example, magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, or any combination thereof.

Salts can include, for example, inorganic salts, such as inorganic alkali metal salts and inorganic alkaline earth metal salts that do not contain carbon.

Salts can include, for example, organic salts, such as organic alkali metal salts and organic alkaline earth metal salt that contain carbon.

The additional ingredient(s) can be, for example, contained in the SCFT in an amount ranging from about 0.00001% by weight to about 10% by weight, based on the weight of the SCFT.

Some examples of optional additional ingredients can be, for example, U.S. powdered sugar 10×, DISINTEX 75, polyvinylpyrrolidone K15, sodium sulfate, and sodium chloride.

Forms, Shapes, Appearance of SCFTs

The form of the SCFT is not limited, and can be for example, a pastille, a granule, a pellet, a powder, a pulverized powder, a tablet, or crystalline (e.g., crystal(s)). In some embodiments, the SCFT can be in the form of a unit dose which can be, for example, a pastille, a granule, a pellet, a powder, a pulverized powder, a tablet, or crystalline. Pastilles, granules, pellets, powders, tablets, or crystals can, for example, be combined together. The combinations can, for example, contain pastilles, granules, pellets, powders, tablets, or crystals that have the same ingredients in the same amounts, or can, for example, contain different ingredients, or different amounts of the same ingredients.

As the size of the SCFT increases to a certain point, there may become a need for including a disintegrant. The disintegrant can be one or more known disintegrants. The disintegrant can be, for example, one or more of hydroxypropyl starch, lactose, corn starch, alginic acid, calcium alginate, carboxymethylcellulose calcium, carboxymethylcellulose sodium, cellulose, cellulose powdered, chitosan, colloidal silicon dioxide, corn starch and pregelatinized starch, croscarmellose sodium, crospovidone, docusate sodium, glycine, guar gum, low-substituted hydroxypropyl cellulose, magnesium aluminum silicate, methyl cellulose, microcrystalline cellulose, polacrilin potassium, povidone, sodium alginate, sodium starch glycolate, pregelatinized starch, DISINTEX 75, or any combination thereof. Disintegrant(s) can optionally be present in the SCFT, for example, in a total amount ranging from about 0.1% by weight to about 10% by weight, based on the total weight of the SCFT. The total amount of disintegrant(s) in the SCFT can be, for example, about 1% by weight, about 3% by weight, about 5% by weight, about 7% by weight, or about 9% by weight, based on the total weight of the SCFT.

The shape of the SCFT is not limited, and can be for example, cubic, conical, spherical, hemi-spherical, an oblate spheroid, a prolate spheroid, irregular, fractal, star shaped, box shaped, heart shaped, diamond shaped, club shaped, spade shaped, disc shaped, lentil shaped, oblong shaped, or combinations thereof.

The appearance of the SCFT is not limited, and can be for example, shiny, dull, smooth, rough, pearlescent, opaque, translucent, or transparent.

Process of Making SCFTs

The present disclosure provides a process of making a SCFT comprising mixing and melting a PEG and a dry powder of encapsulated fragrance to form a mixture, allowing the mixture to shape, and hardening the shaped mixture. In some embodiments, the method further comprises adding fragrance (e.g., a free fragrance and/or an encapsulated fragrance slurry), and optionally a colorant, a glycol fatty ester, a filler, or combinations thereof, into the mixture before or after melting.

The present disclosure also provides a process of making a SCFT comprising mixing and melting a block copolymer (e.g., copolymers of Formula (I) through (IV) described herein) and a dry powder of encapsulated fragrance to form a mixture, allowing the mixture to shape, and hardening the shaped mixture. In some embodiments, the method further comprises adding fragrance (e.g., a free fragrance and/or an encapsulated fragrance slurry), and optionally a colorant, a glycol fatty ester, a filler, or combinations thereof, into the mixture before or after melting.

The present disclosure further provides a process of making a SCFT comprising mixing and melting a PEG, a block copolymer (e.g., copolymers of Formula (I) through (IV) described herein) and a dry powder of encapsulated fragrance to form a mixture, allowing the mixture to shape, and hardening the shaped mixture. In some embodiments, the method further comprises adding fragrance (e.g., a free fragrance and/or an encapsulated fragrance slurry), and optionally a colorant, a glycol fatty ester, a filler, or combinations thereof, into the mixture before or after melting.

The SCFTs can be made, for example, by mixing and heating the PEG and/or the block copolymers (e.g., copolymers of Formula (I) through (IV) described herein) and the dry powder of encapsulated fragrance, and optionally the fragrance (e.g., a free fragrance and/or an encapsulated fragrance slurry), the colorant, the glycol fatty ester, the filler, or combinations thereof; and then shaping or allowing the mixture to shape; and hardening the shaped mixture.

Alternatively, the SCFTs can be made, for example, by first heating the PEG or the block copolymer (optionally in the presence of one or more or all of the ingredients in the SCFTs) until the PEG or the block copolymer melts, and then adding and/or mixing with the dry powder of encapsulated fragrance and/or the remaining ingredients of the SCFTs (if any).

In one embodiment, the SCFTs can be made, for example, by first heating the PEG and the block copolymer(s) (optionally in the presence of one or more or all of the ingredients in the SCFTs) until the PEG and the block copolymer(s) melt, and then adding and/or mixing with the dry powder of encapsulated fragrance and/or the remaining ingredients of the SCFTs (if any).

In some embodiments, the dry powder of encapsulated fragrance, and optionally the fragrance, the colorant, glycol fatty ester, filler, or combinations thereof, may be added to the PEG and/or block copolymer(s) before or after the PEG and/or block copolymer(s) are melted.

In some embodiments, the PEG and/or the block copolymer and any other ingredients of the SCFT are heated to form a melt, optionally with mixing, e.g., by using an overhead mixer with a 3-bladed propeller or a high shear mixer. The agitation rate can be, for example, less than about 500 revolutions per minute ("rpm"), or less than about 400 rpm, or less than about 300 rpm. Then, the remaining ingredients (if any), are added into and blended with the molten mixture. The mixture is portioned into drops or beads that can be substantially hemi-spherical, optionally shaped and then hardened. In one embodiment, the molten mixture is stirred, optionally shaped into drops at a processing temperature, or released as drops to a surface, and allowed to cool and harden to form pastilles. In some embodiments, the mixture is extruded or injected to molds, and/or roll to size and cut to a module. In other embodiments, the mixture is pelletized and prilled followed by cooling to form final shapes. When the specification and/or claims refer to "shaping or allowing the mixture to shape" this refers to any step in which the mixture is portioned and thereafter worked on by natural or applied forces to take a final shape prior to the mixture hardening. In some embodiments the surface comprises a polymeric film.

The SCFTs can be in any form, e.g., in the form of tablets, pellets, pastilles, granules, or powders. To make tablets or pellets, the ingredients in the SCFTs can be blended together, for example, at room temperature, and compressed to form tablets or pellets. The blends can be dry powder blends.

The tablets or pellets can be formed using any known press, for example, a rotary press. The compression force can range, for example, from about 1,000 pounds to about 15,000 pounds. The tableting compression force can be, for example, about 2,000 pounds, about 3,000 pounds, about 4,000 pounds, about 5,000 pounds, about 6,000 pounds, about 7,000 pounds, about 8,000 pounds, about 9,000 pounds, about 10,000 pounds, about 11,000 pounds, about 12,000 pounds, about 13,000 pounds, or about 14,000 pounds.

In some embodiments, the PEG and/or the block copolymer and any other ingredients of the SCFT are mixed and melted, and the mixture is cooled to a processing temperature above the glass transition temperature of the mixture, and/or below the melting temperature of the mixture. The processing temperature may be from about 5° C. to about 40° C., or about 5° C. to about 30° C., or about 5° C. to about 20° C., or from about 5° C. to about 15° C., or from about 10° C. to about 15° C. below the melting temperature of the mixture.

In one embodiment, the mixture can be cooled to a processing temperature that ranges from about 30° C. to about 65° C., or from about 30° C. to about 60° C., or from about 30° C. to about 55° C., or from about 30° C. to about 50° C., or from about 35° C. to about 65° C., or from about 35° C. to about 60° C., or from about 35° C. to about 55° C., or from about 35° C. to about 50° C., or from about 40° C. to about 65° C., or from about 40° C. to about 60° C., or from about 40° C. to about 55° C., or from about 40° C. to about 50° C.

Process of Aerating the Molten Mixture

The present disclosure also provides a method of making an aerated solid compositions for fabric treatment comprising mixing and melting a PEG and/or a block copolymer (e.g., copolymers of Formula (I) through (IV), and a dry powder of encapsulated fragrance to form a mixture, incorporating or entrapping air or gaseous material into the mixture, allowing the mixture to shape, and hardening the shaped mixture. In some embodiments, the method further comprises adding a fragrance (e.g., a free fragrance and/or an encapsulated fragrance slurry), and optionally colorant and filler into the mixture before or after melting.

In some embodiments, the aerated SCFTs can be made, for example, by first heating a PEG and/or a block copolymer (e.g., copolymers of Formula (I) through (IV), optionally in the presence of one more or all of the ingredients in the aerated SCFT, until the PEG and/or the block copolymer or the mixture melts, adding and/or mixing with the remaining ingredients of the aerated SCFT (if any), and aerating, i.e., incorporating or entrapping air or gaseous material into, the mixture. For example, the dry powder of encapsulated fragrance, the fragrance (e.g., a free fragrance and/or an encapsulated fragrance slurry), colorant, filler, or combinations thereof, may be added to the PEG(s) and/or a block copolymer(s) (e.g., copolymers of Formula (I) through (IV), before or after the PEG(s) and/or the block copolymer(s), are melted.

In some embodiments, the PEG(s) and/or a block copolymer (e.g., copolymers of Formula (I) through (IV), and any other ingredients are heated to form a melt, and optionally mixed. Then, the remaining ingredients (if any) are added into and blended with the molten mixture. Air or gaseous material is then incorporated into or entrapped in the mixture. The mixtures are allowed to shape and harden. In one embodiment, the mixtures are shaped into drops, released to a surface, and allowed to cool and harden to form pastilles. In some embodiments the surface comprises a polymeric film.

Air or gaseous material can be entrapped or incorporated into an aerated SCFT by adding air or gaseous material to the aerated SCFT while the aerated SCFT is in liquid, melted, or molten form.

The air or gaseous material can comprise, for example, air, nitrogen, argon, helium, carbon dioxide, or combinations thereof.

In some embodiments, the air or gaseous material is incorporated into or entrapped in the aerated SCFT by agitating or whipping the mixture of ingredients. Agitating or whipping the mixture can be done by, for example, using a mixer. The mixer can be, for example, a low-shear overhead mixer with a 3-bladed propeller. Agitating or whipping the mixture can also be done using a high-shear mixing process, batch mixing, and in-line mixing with static or high-shear mixers.

The agitation or whipping rate can be, for example, greater than about 200 revolutions per minute ("rpm"), or greater than about 300 rpm, or greater than about 400 rpm, or greater than about 500 rpm, or greater than about 600 rpm, or greater than about 700 rpm, or greater than about 800 rpm, or greater than about 900 rpm, or greater than about 1000 rpm, or greater than about 1100 rpm, or greater than about 1200 rpm, or greater than about 1300 rpm, or greater than about 1400 rpm, or greater than about 1500 rpm, or greater than about 2000 rpm, or greater than about 3000 rpm, or greater than about 4000 rpm, or greater than about 5000 rpm.

In some embodiments, the air or gaseous material is incorporated into or entrapped in the aerated SCFT by sparging air or gaseous material into the mixture. Sparging air or gaseous material into the mixture can be done by, for example, bubbling or injecting the air or gaseous material into the mixture. The air or gaseous material can be bubbled through or injected into the mixture by, for example, using a sparger, a diffuser, or an aerator.

In some embodiments, the air or gaseous material is incorporated into or entrapped in the aerated SCFT by, for example, using an aerator. The aerator can be, for example, a waterfall aerator, a bubble aerator, a mechanical aerator, a pressure aerator, or combinations thereof.

In one embodiment, the mixture is aerated, agitated, whipped, and/or sparged, preferably for a sufficient amount of time. A sufficient amount of time can be, for example, the amount of time required to cause the color of the mixture to lighten. A sufficient amount of time can depend on the mixing conditions. For example, a sufficient amount of time can be lower with a higher agitation or whipping rate, and conversely, a sufficient amount of time can be higher with a lower agitation or whipping rate.

A sufficient amount of time can be, for example, at least about 1 second, or at least about 5 seconds, or at least about 10 seconds, or at least about 30 seconds, or at least about 1 minute, or at least about 2 minutes, or at least about 3 minutes, or at least about 5 minutes, or at least about 10 minutes, or at least about 15 minutes, or at least about 20 minutes, or at least about 30 minutes, or at least about 45 minutes, or at least about 60 minutes.

A sufficient amount of time can also be, for example, the amount of time required to decrease the density of the mixture by at least about 1%, or by at least about 2%, or by at least about 3%, or by at least about 4%, or by at least about 5%, or by at least about 6%, or by at least about 7%, or by at least about 8%, or by at least about 9%, or by at least about 10%, or by at least about 11%, or by at least about 12%, or by at least about 13%, or by at least about 14%, or by at least about 15%, or by at least about 16%, or by at least about 17%, or by at least about 18%, or by at least about 19%, or by at least about 20% less than the density of a reference composition without entrapped air. A reference composition is a SCFT without entrapped air. The density of the mixture can be measured by methods known in the art by a person of ordinary skill in the art.

A sufficient amount of time can also be, for example, the amount of time required to increase the volume of the mixture by a value ranging from about 0.1% to about 300%, or from about 0.1% to about 200%, or from about 0.1% to about 100%, or from about 0.1% to about 75%, or from about 0.1% to about 50%.

A sufficient amount of time can also be, for example, the amount of time required to increase the volume of the mixture by at least about 0.1%, or by at least about 1%, or by at least about 5%, or by at least about 10%, or by at least about 20%, or by at least about 30%, or by at least about 40%, or by at least about 50%, or by at least about 100%, or by at least about 200%, or by at least about 300%. The volume of the mixture can be measured by methods known in the art by a person of ordinary skill in the art.

The amount of air or gaseous material incorporated or entrapped in the mixture can be measured by methods known in the art by a person of ordinary skill in the art. The amount of air or gaseous material incorporated or entrapped in the mixture can be measured, for example, by measuring the volume of a batch of the mixture before incorporating or entrapping air or gaseous material, measuring the volume of the same batch of the mixture after incorporating or entrapping air or gaseous material, and comparing the volume measurements, wherein the increase in volume after incorporating or entrapping air or gaseous material represents the volume of the incorporated or entrapped air or gaseous material.

A sufficient amount of time can vary depending on the rate of aeration, sparging, agitation, or whipping. For example, a sufficient amount of time can decrease as the rate of aeration, sparging, agitation, or whipping increases, and vice versa.

Laundry Detergent Compositions

The present disclosure provides a laundry detergent composition comprising a detergent and a SCFT. The detergent comprises at least one detersive surfactant. The surfactant can be, for example, a non-ionic surfactant, a cationic surfactant, an anionic surfactant, a zwitterionic surfactant, or any combination thereof.

The laundry detergent compositions can further comprise additional ingredients described herein. For example, the laundry detergent compositions can further comprise one or more salts, fragrance(s), or combinations thereof. The one or more salts can include the salts as described herein, including, but not limited to, alkali metal salts, alkaline earth metal salts, and combinations thereof. In one embodiment, the salt is sodium chloride.

The laundry detergent compositions may contain other ingredients commonly included in a detergent composition, for example, a builder and a beneficial agent that includes, but is not limited to comprising an enzyme, an anti-redeposition agent, an optical brightener, a biocidal agent, a foam stabilzing agent, an anti-redeposition agent, an anti-creasing agent, a color transfer inhibitor, an anti-microbial, a germicide, a fungicide, an anti-oxidant, an anti-slip agent, a pH adjusting agent, a UV absorber, a corrosion inhibitor, or a combination thereof.

In another embodiment is provided a method for making a laundry detergent composition comprising blending, mixing or combining SCFTs of the present disclosure and a detergent. The detergent comprises at least one detersive surfactant. The ratio of detergent to SCFT can be, for example, about 100:1 to about 1:100, on a weight to weight basis. The ratio of detergent to SCFT can be, for example, about 90:1, about 80:1, about 70:1, about 60:1, about 50:1, about 40:1, about 30:1, about 20:1, about 10:1, about 1:10, about 1:20, about 1:30, about 1:40, about 1:50, about 1:60, about 1:70, about 1:80, or about 1:90, on a weight to weight basis. The ratio of detergent to SCFT can be, for example, about 55:10, or about 50:15, or about 45:18, or about 42:20, or about 40:25, on a weight to weight basis.

In another embodiment is provided laundry detergent composition made by a method comprising blending or mixing or combining a SCFT and a detergent. The detergent can comprise a surfactant.

Unit Dose(s) SCFTs

In some embodiments, the SCFTs of the present disclosure are provided in a unit dose, such as, for example, a unit dose laundry detergent composition or a unit dose fabric treatment composition.

In one embodiment, a unit dose SCFT comprises one or more SCFTs in the form of a pastille, a granule, a pellet, a powder, a pulverized powder, a tablet, or crystalline (e.g., crystal(s)).

In one embodiment, a unit dose SCFT comprises a water-soluble container and a SCFT. The water-soluble container can comprise a single-chamber or a multi-chamber container. In one embodiment, the water-soluble container comprises a water-soluble polymer or film, including, but not limited to, polyvinylalcohol (PVOH) or a PVOH film.

In one embodiment, a unit dose SCFT comprises one or more SCFTs and one or more additional ingredients (e.g., sodium chloride, fragrance, or combinations thereof) mixed or blended together. In another embodiment, a unit dose SCFT comprises one or more SCFTs and one or more additional ingredients mixed or blended together and contained within a water-soluble container.

In another embodiment is provided a unit dose laundry detergent composition.

In one embodiment, a unit dose laundry detergent composition can comprise a SCFT and a detergent. The detergent can comprise at least one detersive surfactant.

All detersive surfactants suitable for use in a detergent (e.g., laundry application, etc.) composition can be used herein. The detersive surfactants include, but are not limited to an anionic surfactant, a nonionic surfactant, a cationic surfactant, an ampholytic surfactant, a zwitterionic surfactant, or mixtures thereof.

In another embodiment, a unit dose laundry detergent composition can comprise a water-soluble container, a SCFT, and a detergent comprising at least one detersive surfactant.

In a further embodiment, a unit dose laundry detergent composition can comprise a water-soluble container, a SCFT, a detergent comprising at least one detersive surfactant, and optionally a solid material. The solid material can be, for example, sodium chloride, a fragrance, or combinations thereof.

In further embodiments, unit dose laundry detergent compositions can comprise one or more additional ingredients, which include, but are not limited to, an inorganic alkali metal salt, an inorganic alkaline earth metal salt, an organic alkali metal salt, an organic alkaline earth metal salt, an acid, a base, a carbohydrate, a silicate, a urea, a polymer (e.g., a soil release polymer and an anti-redeposition polymer) a fragrance, a colorant, a colorant stabilizer, a flow aid, a builder, a solubilizer, an activator, an antioxidant, an inhibitor, a binder, an enzyme protecting agent, an amino acid, a protein, a surfactant, an electrolyte, a bleaching agent, a bluing agent, an optical brightener, a pH adjusting agent, a UV absorber, a corrosion inhibitor, a fabric conditioner, a water softener agent, a caking inhibitor, a bitter agent, and combinations thereof. Examples of additional ingredients, suitable for use in accordance with the unit doses of the present disclosure are described in U.S. Patent Application Nos. 2013/0095717 A1; 2016/0160156 A1; and 2016/0160157 A1, each of which is incorporated herein by reference in its entirety.

In one embodiment, a unit dose laundry detergent composition comprises one or more SCFTs, a detergent comprising at least one detersive surfactant, and one or more additional ingredients mixed or blended together. In another embodiment, a unit dose laundry detergent composition comprises one or more SCFTs, a detergent comprising at least one detersive surfactant, and one or more additional ingredients mixed or blended together and contained within a water-soluble container as described herein. In a further embodiment, a unit dose laundry detergent composition comprises one or more SCFTs, a detergent comprising at least one detersive surfactant, and one or more additional ingredients contained separately within a water-soluble container. In another embodiment, a unit dose laundry detergent composition comprises one or more SCFTs and a detergent in separate chambers within a multi-chamber water-soluble container.

In one embodiment is provided a method of making a unit dose SCFT comprising enclosing all the ingredients within a water-soluble container. The container may be a single-chamber container (e.g., pouch), or multi-chamber container.

In one embodiment is provided a method of making a unit dose laundry detergent composition comprising mixing or blending all the ingredients and enclosing them within a water-soluble container. In another embodiment is provided a method of making a unit dose laundry detergent composition comprising enclosing the SCFT and detergent in separate chambers within a water-soluble container.

An exemplary unit dose laundry detergent composition can be prepared using the liquid laundry detergent formulations shown in TABLE 1 and a SCFT of the present disclosure. Liquid laundry detergent formulations were prepared as follows:

TABLE 1

Liquid compositions formulations

| | Component | | | | | | |
|---|---|---|---|---|---|---|---|
| | 1 | 2 | 3 | 4 | 5 | 6 | 7 |
| C12-C15 alcohol ethoxylate 7EO | 20.0000 | 20.0000 | 20.0000 | 20.0000 | 20.0000 | 20.0000 | 20.0000 |
| hexylene glycol | 29.0364 | 28.5364 | 28.0364 | 27.5364 | 27.0364 | 27.5364 | 27.0364 |
| glycerin | 5.0000 | 5.0000 | 5.0000 | 5.0000 | 5.0000 | 5.0000 | 5.0000 |
| monoethanolamine | 1.7000 | 1.7000 | 1.7000 | 1.7000 | 1.7000 | 1.7000 | 1.7000 |
| deionized water | 6.1200 | 6.1200 | 6.1200 | 6.1200 | 6.1200 | 6.1200 | 6.1200 |
| sodium sulfite | 0.1000 | 0.1000 | 0.1000 | 0.1000 | 0.1000 | 0.1000 | 0.1000 |
| linear alkyl benzene sulfonic acid (LAS) | 5.0000 | 5.0000 | 5.0000 | 5.0000 | 5.0000 | 5.0000 | 5.0000 |
| coconut oil fatty acid | 5.0000 | 5.0000 | 5.0000 | 5.0000 | 5.0000 | 5.0000 | 5.0000 |
| sodium lauryl ether sulphate 2 EO | 21.4286 | 21.4286 | 21.4286 | 21.4286 | 21.4286 | 21.4286 | 21.4286 |
| Soil-releasing polymer | 2.5000 | 2.5000 | 2.5000 | 2.5000 | 2.5000 | 2.5000 | 2.5000 |
| ALCOSPERSE ® 747 | 0.0000 | 0.5000 | 1.0000 | 1.5000 | 2.0000 | 0.0000 | 0.0000 |
| ACUSOL ® 445N | 0.0000 | 0.0000 | 0.0000 | 0.0000 | 0.0000 | 1.5000 | 0.0000 |
| DEQUEST SPE 1202 | 0.0000 | 0.0000 | 0.0000 | 0.0000 | 0.0000 | 0.0000 | 2.0000 |
| Enzymes | 2.8000 | 2.8000 | 2.8000 | 2.8000 | 2.8000 | 2.8000 | 2.8000 |
| Fragrance | 1.0000 | 1.0000 | 1.0000 | 1.0000 | 1.0000 | 1.0000 | 1.0000 |
| Dyes | 0.3150 | 0.3150 | 0.3150 | 0.3150 | 0.3150 | 0.3150 | 0.3150 |
| Total | 100.000 | 100.000 | 100.000 | 100.000 | 100.000 | 100.000 | 100.000 |

The representative unit dose laundry detergent compositions can contain the liquid laundry detergent formulations shown in TABLE 1 and a SCFT in the same or separate chambers within a water-soluble container.

Containers

Unit dose containers and process of manufacture thereof that are suitable for use with the SCFTs, unit doses, or laundry detergent compositions of the present disclosure include those described, for example, in U.S. Pat. Nos. 3,218,776; 4,776,455; 6,727,215; 6,878,679; 7,259,134; 7,282,472; 7,304,025; 7,329,441; 7,439,215; 7,464,519; 7,595,290; and 8,551,929; the disclosures of all of which are incorporated herein by reference in their entireties. In preferred embodiments, the container is a water-soluble, single-chamber container, prepared from a water-soluble film. According to one such aspect of the invention, the single-chamber container is a formed, sealed pouch produced from a water-soluble polymer or film such as polyvinylalcohol (PVOH) or a PVOH film.

The water soluble container used in the compositions of the present invention is made from a water-soluble material which dissolves, ruptures, disperses, or disintegrates upon contact with water, releasing thereby the composition or cleaning system contained within the container. In one embodiment, the single-chamber or -compartment sealed water soluble container, which may be in the form of a pouch, is formed from a water soluble polymer. Non-limiting examples of suitable water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, and mixtures thereof. In one embodiment, the water soluble container is made from a lower molecular weight water-soluble polyvinyl alcohol film-forming resin.

Examples of water soluble polymers for forming the pouch are polyvinyl alcohol (PVOH) resins sold under tradename MonoSol® (MonoSol LLC, Indiana). One embodiment has a grade that is MonoSol® film having a weight average molecular weight range of about 55,000 to 65,000 and a number average molecular weight range of about 27,000 to 33,000. In some embodiments, the film material has a thickness of approximately 3 mil or 75 micrometers. Alternatively, commercial grade PVOH films are suitable for use in the present invention, such as those that are commercially available from Monosol (Merrillville, Ind.) (e.g., Monosol film M8630) or from Aicello (Aiichi, Japan; North American subsidiary in North Vancouver, BC, Canada) (e.g., Aicello fil PT75).

In some embodiments, the water soluble container further comprises a cross-linking agent. In some embodiments, the cross-linking agent is selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmetacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zirconates, or mixtures thereof. In one embodiment, the cross-linking agent is boric acid or sodium borate.

In additional embodiments, the water-soluble container or film from which it is made can contain one or more additional components, agents or features, such as one or more perfumes or fragrances, one or more enzymes, one or more surfactants, one or more rinse agents, one or more dyes, one or more functional or aesthetic particles, and the like. Such components, agents or features can be incorporate into or on the film when it is manufactured, or are conveniently introduced onto the film during the process of manufacturing the cleaning compositions of the present invention, using methods that are known in the film-producing arts.

In some embodiments, the water soluble container comprises a protective layer between the film polymer and the composition in the pouch. In some embodiments, the protective layer comprises polytetrafluoroethylene (PTFE).

The single-compartment, water-soluble container (e.g., pouch) used in association with the present compositions may be in any desirable shape and size and may be prepared in any suitable way, such as via molding, casting, extruding or blowing, and is then filled using an automated filling process. Examples of processes for producing and filling water-soluble containers, suitable for use in accordance with the present invention, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290; the disclosures of all of which are incorporated herein by reference in their entireties. In some embodiments, the pouches are filled with the SCFT and/or the laundry detergent composition of the present disclosure using the cavity filling approach described in U.S. Pat. Nos. 3,218,776 and 4,776,455; machinery necessary for carrying out this process is commercially available, e.g., from Cloud Packaging Solutions (Des Plaines, Ill.; a division of Ryt-way Industries, LLC, Lakeville, Minn.).

Methods of Use

The SCFTs and unit doses of the present disclosure can be used to treat fabrics or textiles, e.g., to impart scent (i.e., apply fragrance to) or soften or clean or decrease static build up when the treated textile is subsequently dried. The SCFTs can be used for delivering or applying fragrance or fabric care to a fabric or a textile, or cleaning a fabric or a textile, or combinations thereof by contacting the fabric or textile with a SCFT of the present disclosure.

In one embodiment is provided a method of treating a fabric or a textile comprising combining or contacting the fabric or textile to be treated, water, and a SCFT. The amount of SCFT can be, for example, about 0.001 g to about 1 kg per treatment. The amount of the SCFT can be, for example, about 0.01 g, about 0.1 g, about 1 g, about 2 g, about 3 g, about 4 g, about 5 g, about 6 g, about 7 g, about 8 g, about 9 g, about 10 g, about 25 g, about 50 g, about 100 g, about 200 g, about 300 g, about 400 g, about 500 g, about 600 g, about 700 g, about 800 g, or about 900 g per treatment.

In a further embodiment, is provided a method of cleaning or cleaning and treating a fabric or a textile with a unit dose SCFT of the present disclosure comprising combining or contacting the fabric or textile to be treated, water, and a unit dose SCFT of the present disclosure. The amount of the unit dose SCFT can be, for example, about 0.001 g to about 1 kg per treatment. The amount of unit dose SCFT can be, for example, about 0.01 g, about 0.1 g, about 1 g, about 2 g, about 3 g, about 4 g, about 5 g, about 6 g, about 7 g, about 8 g, about 9 g, about 10 g, about 25 g, about 50 g, about 100 g, about 200 g, about 300 g, about 400 g, about 500 g, about 600 g, about 700 g, about 800 g, or about 900 g per treatment.

In a further embodiment is provided a method of cleaning or cleaning and treating a fabric or a textile with a unit dose laundry detergent composition of present disclosure comprising combining or contacting the fabric or textile to be treated, water, and the unit dose laundry detergent composition. The amount of the laundry detergent composition can be, for example, about 0.001 g to about 1 kg per treatment. The amount of laundry detergent composition can be, for example, about 0.01 g, about 0.1 g, about 1 g, about 2 g, about 3 g, about 4 g, about 5 g, about 6 g, about 7 g, about 8 g, about 9 g, about 10 g, about 25 g, about 50 g, about 100 g, about 200 g, about 300 g, about 400 g, about 500 g, about 600 g, about 700 g, about 800 g, or about 900 g per treatment.

The SCFTs, laundry detergent compositions, and unit doses containing thereof can be used in a top loading or front loading washer, in hot, warm, or cold water. The SCFTs, laundry detergent compositions, and unit doses containing thereof can be used with a detergent in a wash cycle, or separately but in conjunction with a detergent (e.g., in a separate wash or rinse cycle).

In one embodiment is provided a textile treated by a SCFT, a unit dose, or a laundry detergent composition as disclosed herein.

The act of treating a textile can refer to, or example, one or more of: i) applying a perfume to a textile; ii) softening a textile; iii) applying a perfume to and softening a textile; iv) cleaning a textile; v) rendering the textile resistant to static build up during drying; or vi) cleaning a textile and applying a perfume to and softening a textile and rendering the textile resistant to static build up during drying; or any combination thereof.

The textile, after being treated, may be further processed, for example by drying, pressing, ironing, steaming, sewing, and the like.

The following examples are illustrative and do not limit the scope of the disclosure of the claims.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

All publications, patent applications, patents, and other references mentioned herein are incorporated by reference in their entirety. In case of conflict, the present specification, including definitions, will control. In addition, section headings, the materials, methods, and examples are illustrative only and not intended to be limiting.

EXAMPLES

Example 1: Formation of SCFTs in the Form of Pastilles

Molten PEG 4000 was homogeneously mixed with a dry powder of encapsulated fragrance (Supersoft MDRY Popscent 190870), and a free fragrance (neat oil), and/or an encapsulated fragrance slurry (Swisspop 290437 MHN 2925, approximately 30% by weight encapsulated fragrance in approximately 70% by weight water), and the mixture was heated until melted with stirring, to create a homogenously mixed molten mixture. Alternatively, a colorant and/or a filler were added to the melted mixture. Mixing was affected, and the mixture was then dropped repeatedly onto a polymeric film to form drops. The drops were hardened to form pastilles, which were then removed from the polymeric film. Seven exemplary SCFT formulations (Formulae 1-7) are described in Table 2 below:

TABLE 2

SCFT Formulations

| | Formulas (% by weight) | | | | | | |
|---|---|---|---|---|---|---|---|
| Ingredient | 1 | 2 | 3 | 4 | 5 | 6 | 7 |
| PEG 4000 | 90.3 | 87.55 | 90.3 | 87.55 | 90.3 | 87.55 | 90.39 |
| Supersoft MDRY Popscent 190870 (powder) | 5.5 | 8.25 | 5.5 | 8.25 | 2.750 | 4.125 | 0 |
| Swisspop 290437 MHN 2925 (slurry) | 0 | 0 | 0 | 0 | 2.75 | 4.125 | 5.5 |
| Freshwave 247210V (neat oil) | 4.1 | 4.1 | 0 | 0 | 4.1 | 4.1 | 4.1 |
| Pantera Rosa 256417DB (neat oil) | 0 | 0 | 4.1 | 4.1 | 0 | 0 | 0 |
| Liquitint Pink AL (colorant) | 0 | 0 | 0.1 | 0.1 | 0 | 0 | 0 |
| Liquitint Blue HP (colorant) | 0.1 | 0.1 | 0 | 0 | 0.1 | 0.1 | 0.01 |
| Total | 100 | 100 | 100 | 100 | 100 | 100 | 100 |

Example 2: Properties of SCFT Formulations

Physical properties of the SCFT formulations from Example 1 (Formulae 1-7), were determined, including melting point, strength, and storage solubility. The melting point for each formulation was determined using a Differential Scanning calorimeter (DSC Q2000 by TA Instruments). The strength of each formulation was determined by measuring the force (Newtons) required to break the SCFT using a Dr. Schleuniger Pharmatron Model 6D Tablet Tester. Storage stability was measured by placing 20 grams of SCFTs in a 45 mL PET container with a screw-on cap at a temperature from 4.4° C. to 51.7° C. and 20% RH (relative humidity) for up to 6 months. The melting point and hardness for the SCFT formulations (Formulae 1-7 and Raw material PEG 4000) are summarized in Table 3 below:

TABLE 3

Properties of SCFTs

| Formulas | Approx. Melting Point in Degrees Celsius | Hardness (N) |
|---|---|---|
| PEG 4000 | 61 | N/A |
| 1 | 59.5 | 15.2 |
| 2 | 59 | 13.8 |
| 3 | 57 | 12.8 |
| 4 | 57 | 14.8 |
| 5 | 55 | 10.2 |
| 6 | 54 | 14.2 |
| 7 | 52 | 9 |

The data in Table 3 shows that the PEG 4000 raw material (Formula "PEG 4000") has a melting point of about 61° C., whereas a SCFT containing PEG 4000, 4.1% by weight free fragrance (neat oil), and 5.5% by weight encapsulated fragrance slurry (Formula 7) has a melting point of about 52° C., which is a 9 degree reduction in melting point over the PEG 4000 raw material.

A SCFT made using a dry powder of encapsulated fragrance contains an equivalent amount of encapsulated fragrance (e.g., 8.25% by weight dry powder of encapsulated fragrance has the equivalent fragrance load as 5.5% by weight encapsulated fragrance slurry) and has a melting point of about 59° C. (Formula 2), which is an increase of about 7° C. compared with that of a SCFT made using only an encapsulated fragrance slurry and a free fragrance (Formula 7, 52° C. melting point), and not a dry powder of encapsulated fragrance. The dry powder of encapsulated fragrance allows the use of a higher fragrance load without an elevated risk for melting during transport/storage.

The data in Table 3 also show that a SCFT made using a dry powder of encapsulated fragrance contains an equivalent amount of encapsulated fragrance (e.g., 8.25% by weight dry powder of encapsulated fragrance has the equivalent fragrance load as 5.5% by weight encapsulated fragrance slurry) and has a hardness of about 13.8 Newtons (Formula 2), which is an increase of about 4.8 Newtons compared with that of an SCFT made using only an encapsulated fragrance slurry and a free fragrance (Formula 7, hardness of 9 Newtons), and not a dry powder of encapsulated fragrance. The SCFT made using a dry powder of encapsulated fragrance exhibits enhanced strength.

The storage stability of each SCFT of formulae 1-7 are summarized in Table 4 below:

TABLE 4

Storage Stability of SCFTs of Formulae 1-7 After 6 Months

| | Storage Stability | | | | |
|---|---|---|---|---|---|
| Formula | 4.4° C. | 23.9° C. | 40.6° C. | 45° C. | 51.7° C. |
| 1 | Stable | Stable | Stable | Stable | Sticking |
| 2 | Stable | Stable | Stable | Stable | Sticking |
| 3 | Stable | Stable | Stable | Stable | Sticking |
| 4 | Stable | Stable | Stable | Stable | Sticking |
| 5 | Stable | Stable | Slight Sticking | Sticking | Sticking |
| 6 | Stable | Stable | Slight Sticking | Sticking | Significant Sticking |
| 7 | Stable | Stable | Slight Sticking | Significant Sticking | Significant Sticking |

Definitions for Storage Stability (Table 4): "Stable" means that no SCFTs are sticking or fusing together. "Slight Sticking" means less than 5% of the SCFT are sticking to one another, but shaking the container causes SCFTs to no longer stick to one another. "Sticking" means 5 to 25% of the SCFTs are sticking to one another and still stick to one another after shaking the container. "Significant Sticking" means more than 25% of the SCFTs are sticking to one another and still stick to one another after shaking container.

The data in Table 4 shows that a SCFT made using a dry powder of encapsulated fragrance contains an equivalent amount of encapsulated fragrance (e.g., 8.25% by weight dry powder of encapsulated fragrance has the equivalent fragrance load as 5.5% by weight encapsulated fragrance slurry) and remained stable at temperatures of 4.4° C., 23.9° C., 40.6° C., and 45° C. (Formula 2), whereas an SCFT made using only an encapsulated fragrance slurry and a free fragrance (Formula 7) showed instability and started to melt at a temperature of 40.6° C. The data in Table 4 shows how using a dry powder of encapsulated fragrance to make a SCFT, as disclosed herein, reduces the risk of melting and enhances the storage stability under different temperature conditions.

Having now fully described this invention, it will be understood by those of ordinary skill in the art that the same can be performed within a wide and equivalent range of conditions, formulations and other parameters without affecting the scope of the invention or any embodiment thereof. All patents, patent applications, and publications cited herein are fully incorporated by reference herein in their entirety.

The foregoing description of the specific embodiments has revealed the general nature of the invention such that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A process of making a solid composition for fabric treatment, comprising:

forming a mixture by mixing and melting a block copolymer and a dry powder of encapsulated fragrance;

shaping or allowing the mixture to shape; and hardening the shaped mixture;

wherein the block copolymer has a Formulae (I), (II), (III) or (IV), $$R^1O\text{-}(EO)x\text{-}(PO)y\text{-}R^2 \quad \text{(I)},$$

$$R^1O\text{—}(PO)x\text{-}(EO)y\text{-}R^2 \quad \text{(II)},$$

$$R^1O\text{-}(EO)o\text{-}(PO)p\text{-}(EO)q\text{-}R^2 \quad \text{(III)},$$

$$R^1O\text{—}(PO)o\text{-}(EO)p\text{-}(PO)q\text{-}R^2 \quad \text{(IV)},$$

or a combination thereof;

wherein EO is a $—CH_2CH_2O—$ group, and PO is a $—CH(CH_3)CH_2O—$ group;

$R^1$ and $R^2$ independently is H or a $C_1$-$C_{22}$ alkyl group;

x, y, o, p, and q are independently 1-100;

provided that the sum of x and y is greater than 35, and the sum of o, p and q is greater than 35;

wherein the block copolymer is present in an amount of about 75% by weight to about 99% by weight of the composition; and wherein the dry powder of encapsulated fragrance is present in an amount from about 0.01% by weight to about 10% by weight of the composition.

2. The process of claim 1, wherein said forming a mixture comprises melting the block copolymer and then adding the dry powder of encapsulated fragrance.

3. The process of claim 1, further comprising adding a polyethylene glycol to the melted mixture, wherein the polyethylene glycol has an average molecular weight from about 1000 to about 8500.

4. The process of claim 3, wherein the weight ratio of polyethylene glycol to the block copolymer in the composition ranges from about 20:1 to about 1:1.

5. The process of claim 1, wherein the dry powder of encapsulated fragrance comprises starch, corn syrup solids, or a combination thereof.

6. The process of claim 1, further comprising adding an encapsulated fragrance slurry, a free fragrance, or a combination thereof to the mixture.

7. The process of claim 1, further comprising adding a colorant to the melted mixture.

8. The process of claim 1, further comprising adding a glycol fatty acid ester to the mixture.

9. The composition of claim 8, wherein the glycol fatty acid ester is a glycol monostearate or a glycol distearate.

10. The process of claim 1, further comprising aerating the molten mixture to incorporate air or gaseous material into the mixture, before shaping or allowing the mixture to shape; and hardening the shaped mixture.

11. The process of claim 1, further comprising cooling the mixture to a processing temperature above the glass transition temperature of the mixture and below the melting temperature of the mixture.

12. The process of claim 1, wherein the solid composition is spherical, hemi-spherical, lentil shaped, or oblong shaped.

13. A solid composition for fabric treatment prepared by the process of claim 6.

14. A solid composition for fabric treatment prepared by the process of claim 1.

15. A process of making a solid composition for fabric treatment, comprising:

forming a mixture by mixing and melting a polyethylene glycol having an average molecular weight from about 1000 to about 8500, a dry powder of encapsulated fragrance, and a block copolymer;

shaping or allowing the mixture to shape; and hardening the shaped mixture;

wherein the polyethylene glycol is present in an amount from about 50% by weight to about 95% by weight of the composition;

wherein the dry powder of encapsulated fragrance is present in an amount from about 0.01% by weight to about 10% by weight of the composition; and wherein the block copolymer is present in an amount of about 5% by weight to about 50% by weight of the composition;

wherein the block copolymer has a Formulae (I), (II), (III) or (IV), $$R^1O\text{-}(EO)x\text{-}(PO)y\text{-}R^2 \quad (I),$$

$$R^1O\text{—}(PO)x\text{-}(EO)y\text{-}R^2 \quad (II),$$

$$R^1O\text{-}(EO)o\text{-}(PO)p\text{-}(EO)q\text{-}R^2 \quad (III),$$

$$R^1O\text{—}(PO)o\text{-}(EO)p\text{-}(PO)q\text{-}R^2 \quad (IV),$$

or a combination thereof;

wherein EO is a —$CH_2CH_2O$— group, and PO is a —$CH(CH_3)CH_2O$— group;

$R^1$ and $R^2$ independently is H or a $C_1$-$C_{22}$ alkyl group;

x, y, o, p, and q are independently 1-100;

provided that the sum of x and y is greater than 35, and the sum of o, p and q is greater than 35.

16. The process of claim 15, the weight ratio of polyethylene glycol to the block copolymer in the composition ranges from about 2:1.

17. The process of claim 15, wherein the polyethylene glycol has an average molecular weight from about 2000 to about 6000.

18. The process of claim 15, wherein the dry powder of encapsulated fragrance comprises starch, corn syrup solids, or a combination thereof.

19. The process of claim 15, further comprising adding an encapsulated fragrance slurry, a free fragrance, or a combination thereof to the mixture.

20. A solid composition for fabric treatment prepared by a process comprising the steps of:

forming a mixture by mixing and melting a block copolymer and a dry powder of encapsulated fragrance;

shaping or allowing the mixture to shape; and hardening the shaped mixture;

wherein the block copolymer has a Formulae (I), (II), (III) or (IV), $$R^1O\text{-}(EO)x\text{-}(PO)y\text{-}R^2 \quad (I),$$

$$R^1O\text{—}(PO)x\text{-}(EO)y\text{-}R^2 \quad (II),$$

$$R^1O\text{-}(EO)o\text{-}(PO)p\text{-}(EO)q\text{-}R^2 \quad (III),$$

$$R^1O\text{—}(PO)o\text{-}(EO)p\text{-}(PO)q\text{-}R^2 \quad (IV),$$

or a combination thereof;

wherein EO is a —$CH_2CH_2O$— group, and PO is a —$CH(CH_3)CH_2O$— group;

$R^1$ and $R^2$ independently is H or a $C_1$-$C_{22}$ alkyl group;

x, y, o, p, and q are independently 1-100;

provided that the sum of x and y is greater than 35, and the sum of o, p and q is greater than 35.

* * * * *